US008240372B2

(12) United States Patent
Matherne, Jr. et al.

(10) Patent No.: US 8,240,372 B2
(45) Date of Patent: Aug. 14, 2012

(54) FLUID POWER CONDUCTING SWIVEL

(75) Inventors: Lee J. Matherne, Jr., Lafayette, LA (US); Kris Henderson, Lafayette, LA (US); Joseph L. Hawkins, Maurice, LA (US); Lee M. Robichaux, Lafayette, LA (US)

(73) Assignee: Premiere, Inc., New Iberia, LA (US)

( * ) Notice: Subject to any disclaimer, the term of this patent is extended or adjusted under 35 U.S.C. 154(b) by 376 days.

(21) Appl. No.: 12/798,984

(22) Filed: Apr. 15, 2010

(65) Prior Publication Data

US 2011/0253361 A1 Oct. 20, 2011

(51) Int. Cl.
*E21B 19/02* (2006.01)

(52) U.S. Cl. ..... 166/84.1; 166/75.14; 166/379

(58) Field of Classification Search ..... 166/77.51, 166/86.1, 291, 177.4, 379, 380, 77.1, 85.1, 166/85.5, 75.14, 84.1
See application file for complete search history.

(56) References Cited

U.S. PATENT DOCUMENTS 1,704,053 A * 3/1929 Miller ..... 285/111
3,915,244 A * 10/1975 Brown ..... 175/85
6,276,450 B1 * 8/2001 Seneviratne ..... 166/85.1
6,581,692 B1 * 6/2003 Koch et al. ..... 166/380
6,920,926 B2 * 7/2005 York et al. ..... 166/77.1
7,007,753 B2 * 3/2006 Robichaux et al. ..... 166/291
7,108,058 B2 * 9/2006 Pippert ..... 166/84.4
7,140,443 B2 * 11/2006 Beierbach et al. ..... 166/380
7,249,632 B2 * 7/2007 Robichaux et al. ..... 166/291
7,281,582 B2 * 10/2007 Robichaux et al. ..... 166/291
7,533,720 B2 * 5/2009 Robichaux et al. ..... 166/84.1
7,681,646 B2 * 3/2010 Robichaux et al. ..... 166/291
7,874,352 B2 * 1/2011 Odell, II et al. ..... 166/77.51
7,913,760 B2 * 3/2011 Robichaux et al. ..... 166/291
8,196,650 B1 * 6/2012 Robichaux et al. ..... 166/84.1
2005/0034853 A1 * 2/2005 Robichaux et al. ..... 166/85.1
2005/0098352 A1 * 5/2005 Beierbach et al. ..... 175/57
2005/0206090 A1 * 9/2005 Bunn ..... 277/549
2006/0000600 A1 * 1/2006 Pietras ..... 166/77.52
2006/0249292 A1 * 11/2006 Guidry ..... 166/380
2007/0251700 A1 * 11/2007 Mason et al. ..... 166/379
2009/0151934 A1 * 6/2009 Heidecke et al. ..... 166/250.01
2010/0108330 A1 * 5/2010 Shahin et al. ..... 166/382
2010/0193198 A1 * 8/2010 Murray et al. ..... 166/380
2010/0218936 A1 * 9/2010 Robichaux et al. ..... 166/84.1
2011/0232919 A1 * 9/2011 Snider et al. ..... 166/380
2012/0080201 A1 * 4/2012 Robichaux et al. ..... 166/386

* cited by examiner

*Primary Examiner* — Daniel P Stephenson
(74) *Attorney, Agent, or Firm* — Ted M. Anthony

(57) ABSTRACT

A casing running tool capable of handling pipe and tubing has fluid power conducting channels leading from stationary to rotating components, through a swivel. The swivel has a plurality of fluid channels, each confined by dynamic seals that rub peripherally on mating seal surfaces. The seals are carried on at least one piston that is movable, on command, to carry the seals out of contact with the peripherally rubbing surfaces.

12 Claims, 4 Drawing Sheets

FLUID POWER CONDUCTING SWIVEL

This invention pertains to Casing Running Tools (CRT) used with top drives in well production activities. As used herein CRT refers to any string of casing, pipe or tubing. As used herein, Top Drives (TD) refers to any system that is suspended from the traveling block and rotates a pipe string. More specifically, but not as a limitation, the invention deals with seals related to swivels used to conduct fluids from stationary ducts to ducts that rotate, usually in sympathy with a pipe string suspended in a well.

BACKGROUND

Drilling rigs fitted with top drives rotate suspended pipe strings while the pipe strings are being inserted into well bores. CRT elements have pipe gripping and pipe manipulating features that are operated by fluid powered apparatus. Such fluid powered apparatus is usually powered and controlled by consoles on the rig floor. The consoles are stationary and the controlled apparatus, at least in part, is often rotated. A swivel arrangement is used to allow the transfer of fluid power from the stationary to the rotating elements.

The diameter of the necessary fluid seals involved, and the rotational speed, tends to tax the seals durability. Such seals tend to have short service life and seal failures are a persistent problem.

Fluid power is used, by the CRT, to manipulate the pipe and pipe handling gear while the pipe string is not rotating. Fluid power is also used to secure the pipe string to the CRT during rotation.

To improve reliability, the design of CRT equipment benefits from the separation of fluid powered features that operate during non-rotating activity from the features that operate during pipe string rotation. That separation supports the use of accumulators to provide fluid power during pipe string rotation for securing the pipe string to the CRT, for instance. While the CRT is not rotating, fluid power can proceed through the swivel to charge the accumulators. After the accumulators are charged, and before rotation, the fluid power can be reduced to reduce the challenge to the seals in the swivel. That still leaves the seals in sliding contact. There is still a need to better protect the seals. This invention addresses the need to further protect the swivel seals.

SUMMARY

A CRT assembly, secured to a top drive, has pipe string manipulation features that are powered and operated by stationary fluid power sources and controls. The fluid power is conducted, by a plurality of ducts, through a swivel to the CRT. The ducts through the swivel work well when there is pressure in the ducts but no rotation takes place. Before rotation, the pipe securing features in the CRT are powered by fluid pressure in charged accumulators. When rotation is to begin, the fluid pressure in the accumulators is secured by check valves and fluid pressure being carried through the swivel is reduced. The swivel seals no longer required to operated the CRT during rotation are moved to relief areas so that the seals no longer contact the mating seal rubbing surfaces. During subsequent rotation the seals are not subject to friction loads. The seal life is then not taxed by hours of rotation.

When fluid pressure is again needed to operate the rotating features of the CRT, rotation is stopped and the swivel seals are moved to contact their mating rubbing surfaces to secure the fluid ducts. The seals are mounted on a piston that moves to manipulate the seal positions.

From the foregoing, it will be seen that this invention is one well adapted to attain all of the ends and objects hereinabove set forth, together with other advantages which are obvious and which are inherent to the apparatus.

DETAILED DESCRIPTION OF DRAWINGS

Figure 2:
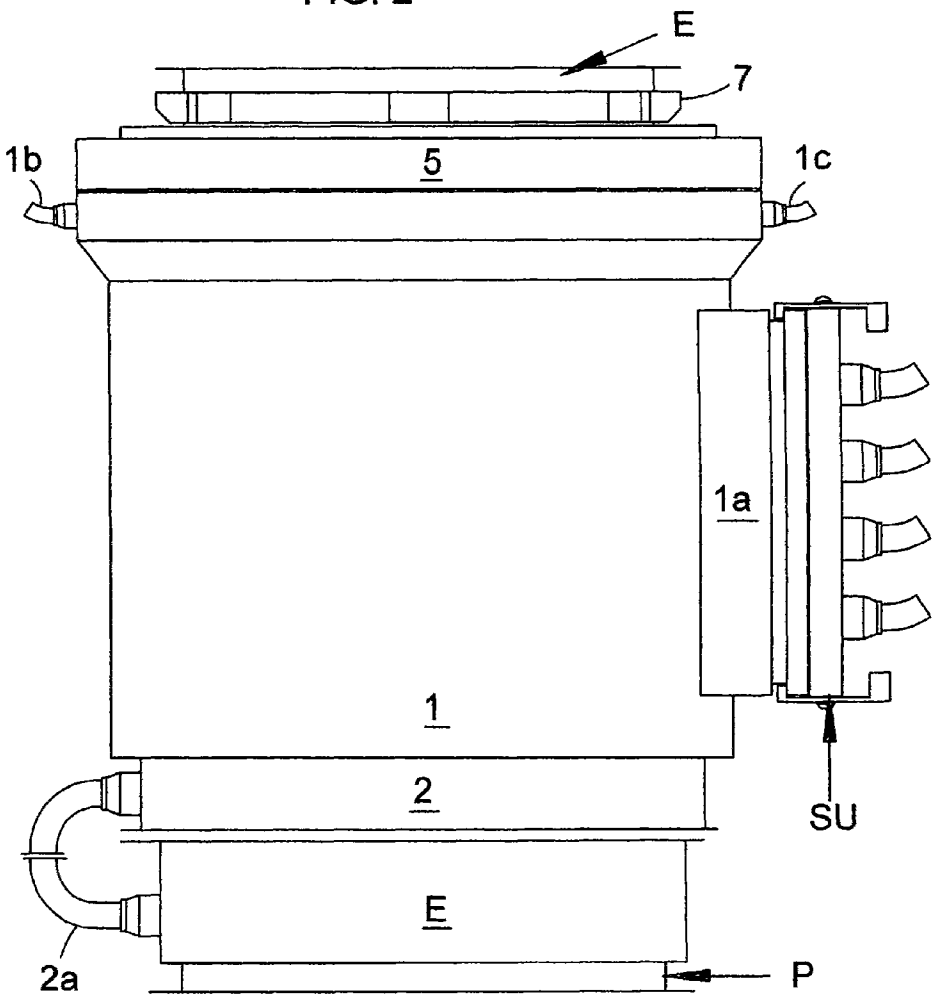
FIG. 2 is a side view of a particular assembly, part of FIG. 1, into which novel features of the invention are enclosed.
Figure 1:
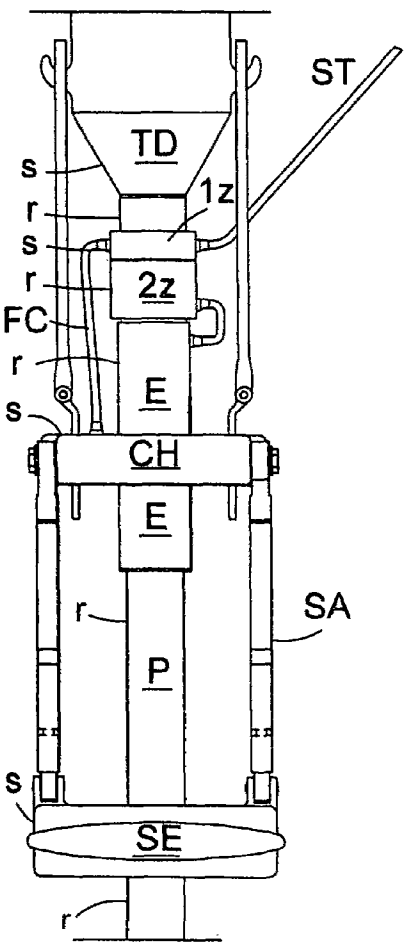
FIG. 1 is a side view of the invention coupled to the extending hardware that allows processing of pipe sections into pipe strings in a well bore.
Figure 4:
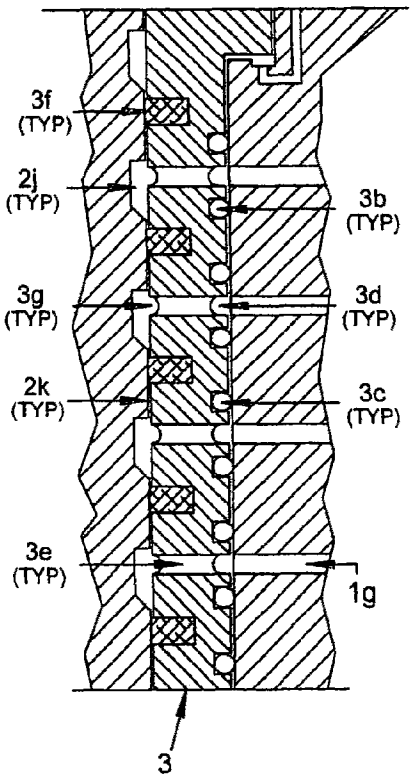
FIG. 4 is a fragment, rather enlarged and in cut-away, of the right side of the apparatus of FIG. 3.
Figure 3:
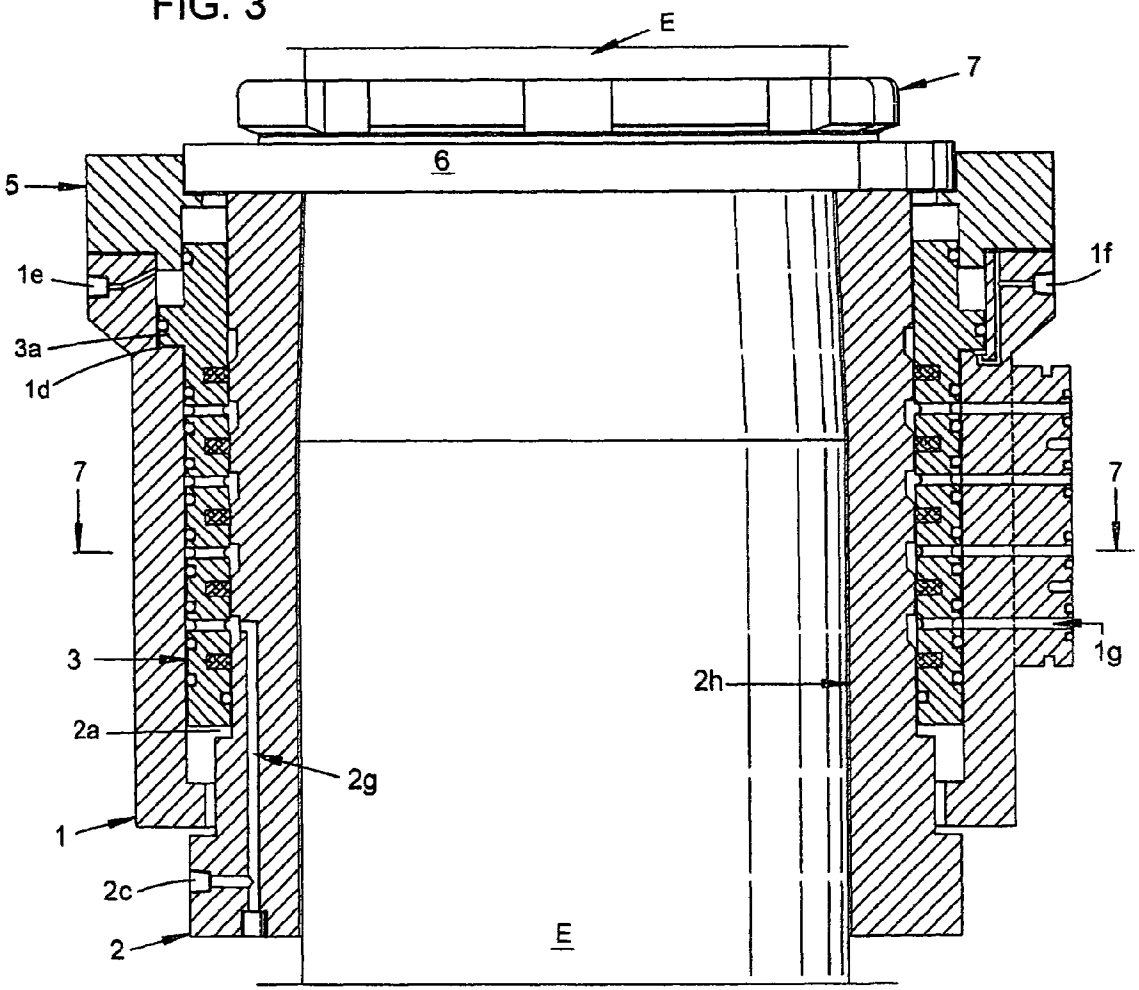
FIG. 3 is a side view, mostly in cut-away, showing the principal features that enable the present invention to function.

FIG. 1 is intended to convey the general principles involved in the disclosure and differs somewhat from FIGS. 2-4. The scales of FIGS. 2-4 permit a more exact description of the invention.

The top drive TD is well known in well drilling activity and its relationship to other drilling rig machinery is well known to those skilled in the related art.

All captions in FIG. 1, shown as "s" or "r" refer to things stationary or rotatable respectively.

FIG. 1 shows a Casing Running Tool (CRT) suspended from a top drive of a drilling rig (not shown) and supporting a pipe string P suspended in a well bore. The top drive TD drives pipe gripping extension E through the swivel assembly 1*z* and 2*z*. Stationary feeder tubes ST, a short length shown, normally extend from a control console on the rig floor to the swivel stationary part 1*z*.

The CRT assembly of FIG. 1 travels vertically with the top drive TD and is designed to facilitate the entry of new sections of pipe into the pipe string P. The crosshead CH is suspended from the top drive and carries swing arms SA, one on each side, which pivot from the top and carry stand elevator SE which can move horizontally a limited amount to secure and align an incoming pipe section (not shown). Ideally, the swing arms SA are telescopic and assist in lifting a new section of pipe into the pipe gripping extension E.

Some fluid power supply lines never need to pass through the swivel and may exit 1*z* and pass to the cross head CH by line(s) FC. The swing arms SA may derive fluid power by way of the same lines FC. All fluid power conducting lines that serve features that rotate may be assumed to pass through the swivel.

FIG. 2 deals almost exclusively with the swivel and related fluid conducting details. Housing 1 contains arbor 2 which is mounted on extension E which, in turn is suspended from the rotating shaft of the top drive TD. Feeder block 1*a* is mounted to accept the stationary umbilical SU. Four feeder lines are shown but any number may be used. Closure 5 is secured to the top of housing 1, preferably by a peripheral distribution of cap screws. Ring nut 7 secures the swivel to the extension E. Connections 1*b* and 1*c* conduct fluid power to control the inner features that manipulate the seals, see FIG. 3. The fluid conducting lines FC may connect to the same flange at different peripheral locations. Jumper lines 2*a* connect fluid circuits from arbor 2 to the extension E, which may rotate.

FIG. 3, sectioned along the axis of rotation, shows the seal carrying piston 3, which rides in cylindrical opening 2*a*. The details of channels and seals are reserved for the larger scale of FIG. 4. The piston is movable axially by piston flange 3*a* in cylinder bore 1*d* in response to fluid pressure applied by ducts 1*e* and 1*f*. The piston 3 is shown in the lower position in which channels such as 1*g* are communicated to channels such as 2*g* and ports 2*c*. Ring 6 retains arbor 2 on the extension E. The seal carrying piston 3 is, in effect, a seal carrying shuttle that may be moved by a piston that is not part of the shuttle.

Extension E contains the features that grip pipe to support a section or string of pipe. Bore 2*h* is shaped to engage the outside of the extension E for axial and rotational security of the swivel.

FIG. 4 is an enlarged fragment of the right hand side of the assembly of FIG. 3. In the position shown, seals 3*f* slide on cylindrical surfaces 2*k* to seal the channels individually. Each channel is sealingly conducted from ports such as 1*g* to a peripheral groove such as 2*j*. Each channel is isolated by such as upper seal 3*c* and lower seal 3*b*. Each channel is conducted through the piston wall by holes such as 3*e*. Four such channels are shown.

Figure 5:
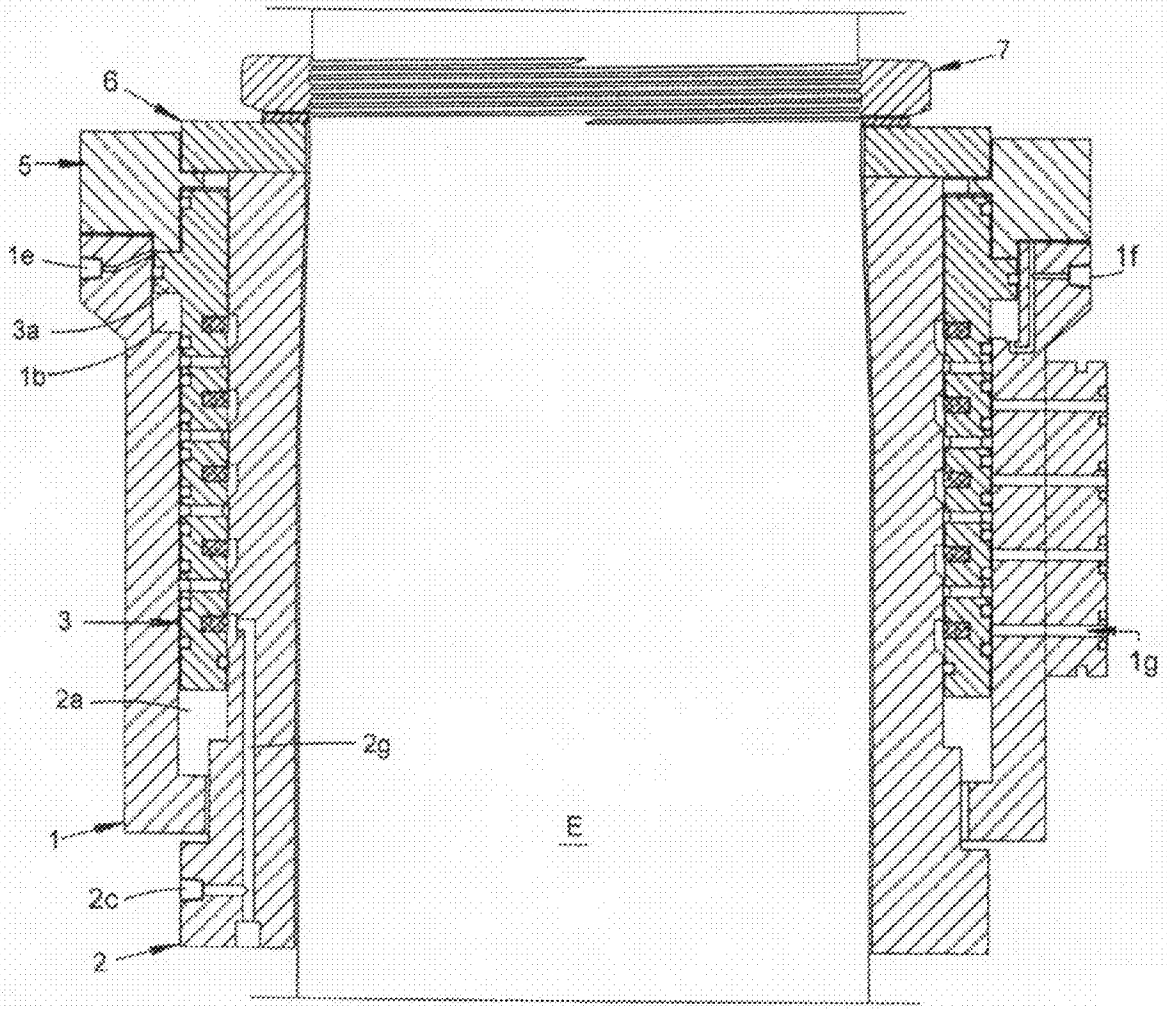
FIG. 5 is a side view, identical to FIG. 3, except that a seal carrying element is in the opposite extreme of travel limit.

FIG. 5 is identical to FIG. 3 but the piston 3 is moved axially to its upper travel limit. Seals 3*f* are now situated to ride over the peripheral grooves such as 2*c* without rubbing contact. Channels such as 1*g* are now closed by seals such as 3*b* and 3*c*. No fluid can enter the piston area from the console, usually on the rig floor. The seals 3*f* do not rub on mating seal surfaces during the lengthy run of the CRT.

Figure 6:
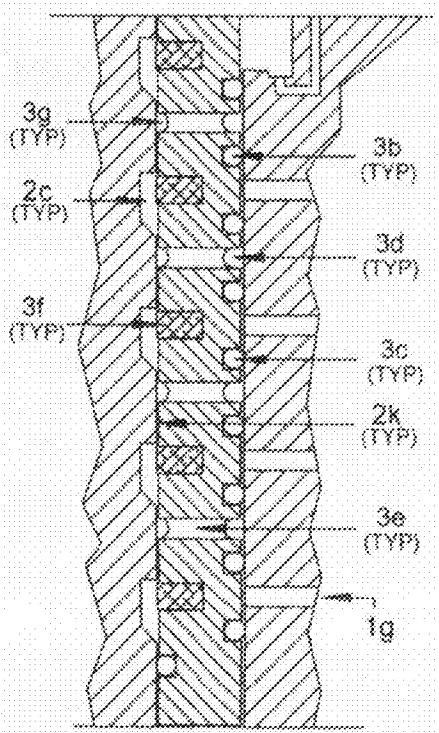
FIG. 6 is identical to FIG. 4 except that a seal carrying element is in the opposite extreme of travel limit.

FIG. 6 is identical to FIG. 4 but with the seals 3*f* out of contact with mating seal surfaces 2*k*.

Figure 7:
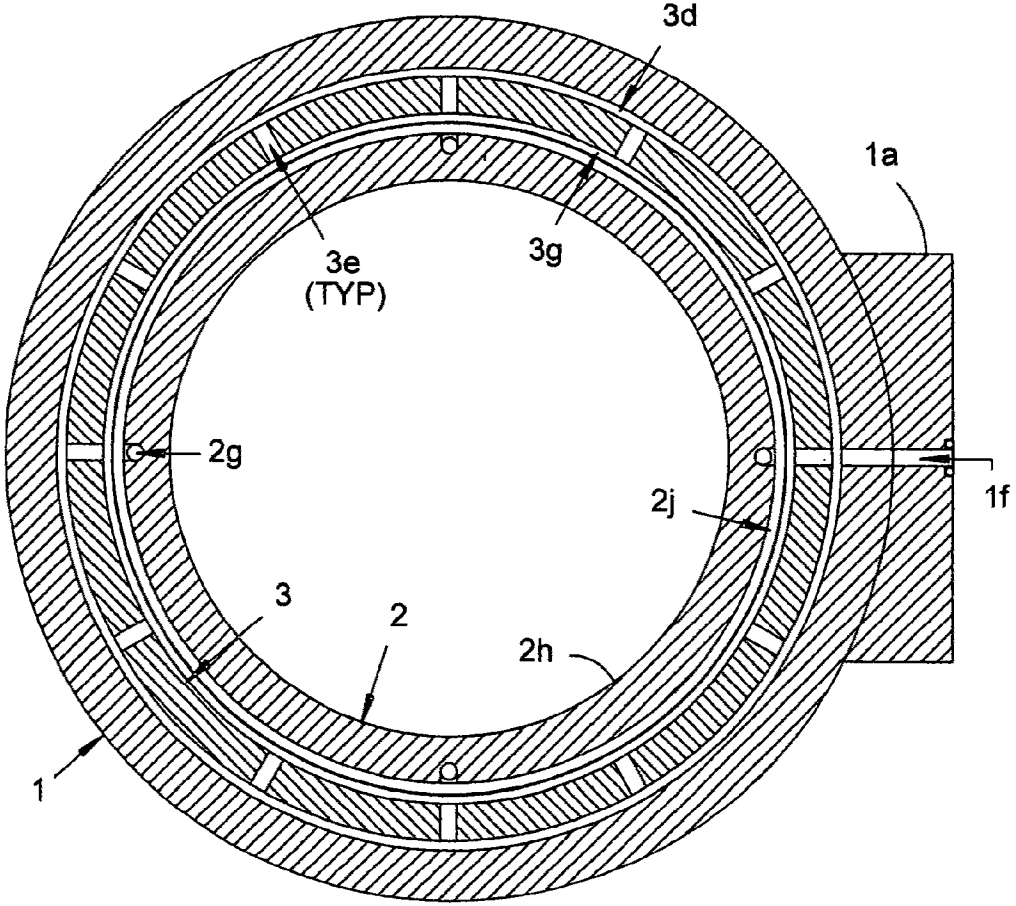
FIG. 7 is a sectional view taken along line 7-7 of FIG. 3.

FIG. 7 shows housing 1, arbor 2, piston 3, all generally cylindrical, and feeder block 1*a*. A plurality of channels 3*e* assure a free flow of fluid through the piston wall.

These and other objects, advantages, and features of this invention will be apparent to those skilled in the art from a consideration of this specification, including the attached claims and appended drawings.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, we claim:

1. A Casing Running Tool (CRT) apparatus usable with a top drive, having a swivel assembly to conduct fluid power from a stationary control to rotating parts of the CRT. The apparatus comprising:

a) a casing running tool comprising swing arms, a single stand elevator, a pipe gripping assembly, and a fluid power conducting swivel situated on said CRT and arranged to said conduct fluid power between stationary and rotating fluid channels;

b) a seal carrier situated in said swivel arranged to move channel seals out of contact with their seal related rubbing surfaces when no fluid is being conducted by said swivel when said pipe gripping assembly is prepared for rotation; and c) said channel seals mounted on a piston that is movable between first and second positions to move said seals into and out of contact with said seal related rubbing surfaces.

2. The apparatus according to claim 1 wherein said piston carries seals arranged to block at least one said fluid channel when said piston is moved to said second position.

3. The apparatus according to claim 1 wherein said fluid power conducting swivel is secured to and moves with said pipe gripping assembly.

4. The apparatus according to claim 1 wherein said fluid power conducting swivel is arranged to provide fluid channels to receive fluid power from stationary lines and deliver said fluid power to non-rotating features of said CRT without passing through channels capable of rotating in said swivel.

5. A Casing Running Tool (CRT) apparatus usable with a top drive, having a swivel assembly arranged to conduct fluid power, along a plurality of individual channels, from a stationary control to rotating parts of the CRT. The apparatus comprising:

a) a casing running tool comprising swing arms, a single stand elevator, a pipe gripping assembly, and a fluid power conducting swivel situated on said CRT and arranged to said conduct fluid power between stationary and rotating fluid channels;

b) each said channel provided with seals to confine said fluid power within each said channel;

c) a seal carrier situated in said swivel, arranged to move seals related to said channels out of contact with their seal related rubbing surfaces when no fluid is being conducted by said swivel when said pipe gripping assembly is prepared for rotation; and d) said channel seals mounted on an axially movable piston that moves, in response to selectively applied fluid pressure, between first and second positions to move said seals into and out of contact with said seal related rubbing surfaces.

6. The apparatus according to claim 5 wherein said piston carries seals arranged to block at least one said fluid channel when said piston is moved to said second position.

7. The apparatus according to claim 5 wherein said fluid power conducting swivel is secured to and moves with said pipe gripping assembly.

8. The apparatus according to claim 5 wherein said fluid power conducting swivel is arranged to provide fluid channels to receive fluid power from stationary lines and deliver said fluid power to non-rotating features of said CRT without passing through channels capable of rotating in said swivel.

9. A Casing Running Tool (CRT) apparatus usable with a top drive, having a swivel assembly arranged to conduct fluid power, along a plurality of individual channels, from a stationary control to rotating parts of the CRT. The apparatus comprising:

a) a casing running tool comprising swing arms, a single stand elevator, a pipe gripping assembly, and a fluid power conducting swivel situated on said CRT and arranged to said conduct fluid power between stationary and rotating fluid channels;

b) each said channel provided with seals to confine said fluid power within each said channel, arranged to slide peripherally on a mating surface;

c) a seal carrier situated in said swivel, arranged to move seals related to said channels out of contact with said mating surface when said pipe gripping assembly is prepared for rotation; and d) said channel seals mounted on an axially movable piston that moves, in response to selectively applied fluid pressure, between first and second positions to move said seals into and out of contact with said seal related rubbing surfaces.

10. The apparatus according to claim 9 wherein said piston carries seals arranged to block at least one said fluid channel when said piston is moved to said second position.

11. The apparatus according to claim 9 wherein said fluid power conducting swivel is secured to and moves with said pipe gripping assembly.

12. The apparatus according to claim 9 wherein said fluid power conducting swivel is arranged to provide fluid channels to receive fluid power from stationary lines and deliver said fluid power to non-rotating features of said CRT without passing through channels capable of rotating in said swivel.

* * * * *